United States Patent [19]

Anderson

[11] Patent Number: 4,548,174

[45] Date of Patent: Oct. 22, 1985

[54] DUAL PLUG IGNITION SYSTEM

[75] Inventor: Richard W. Anderson, Ann Arbor, Mich.

[73] Assignee: Ford Motor Company, Dearborn, Mich.

[21] Appl. No.: 655,269

[22] Filed: Sep. 28, 1984

[51] Int. Cl.[4] ..... F02P 3/04

[52] U.S. Cl. ..... 123/310; 123/638; 123/654; 123/655

[58] Field of Search ..... 123/310, 638, 653, 654, 123/655, 656, 636, 637

[56] References Cited

U.S. PATENT DOCUMENTS 4,177,782 12/1979 Yoshinari .
4,203,403 5/1980 Fujii et al. ..... 123/655 X
4,217,873 8/1980 Nishio et al. ..... 123/655 X
4,407,259 10/1983 Abo .

FOREIGN PATENT DOCUMENTS 18622 11/1980 European Pat. Off. ..... 123/654
37244 4/1978 Japan ..... 123/638

*Primary Examiner*—Tony M. Argenbright
*Attorney, Agent, or Firm*—Peter Abolins; Robert D. Sanborn

[57] ABSTRACT

An ignition system for an internal combustion engine has an ignition coil coupled to a first and second spark plug provided for each cylinder. A first diode is coupled in series between the first spark plug and the ignition coil. A second diode is coupled in series between the second spark plug and the ignition coil. A first capacitor is coupled in parallel with the first spark plug. A second capacitor is coupled in parallel with the second spark plug.

4 Claims, 2 Drawing Figures

DUAL PLUG IGNITION SYSTEM

BACKGROUND OF THE INVENTION

1. Technical Field

This invention relates to an ignition system, and more particularly, to an ignition system wherein each cylinder has more than one ignition plug for igniting the mixture of air and fuel.

2. Prior Art

There are known internal combustion engines with dual plugs for each cylinder. An associated distributor has two separate high voltage contacts per cylinder, i.e. one for each plug. Thus each spark plug in a cylinder is energized by a separate ignition system. The two ignition systems are required to guarantee that each spark plug gap will break down and fire upon triggering of the ignition module. A distributorless ignition system (DIS) similarly requires a duplicate ignition system. It would be desirable to provide simultaneous dual plug operation and eliminate one of the ignition systems. These are some of the problems this invention overcomes.

U.S. Pat. No. 4,177,782 issued to Yoshinari et al teaches an ignition system for an internal combustion engine having two spark plugs in each cylinder wherein each of the spark plugs is fired by one ignition coil. Separate output terminals of a secondary coil of the ignition coil are connected to each of the two plugs. For a distributorless ignition system this would require four double ended coils. For simplicity and reduced cost, it would be desirable to require only two double ended coils for a distributorless ignition system. If the teachings of this patent are used with a distributor, two high voltage post connections for each coil as well as two posts for each cylinder are required. Also, the patent does not teach the simultaneous firing of the two spark plugs in a cylinder.

U.S. Pat. No. 4,407,259 issued to Abo also teaches using two spark plugs. The patent teaches a plasma ignition systemm with a plurality of plasma ignition plugs to eliminate a mechanical distributor for sequentially distributing plasma ignition energy into each plasma ignition plug. When both of the spark plugs break down, only one of the plugs would receive the stored capacitive energy in the ignition system. Again, the patent does not teach particular circuitry for promoting simultaneous firing of two spark plugs in one cylinder.

SUMMARY OF THE INVENTION

An ignition system for an internal combustion engine has an ignition coil with a primary and a secondary winding. An ignition control circuit applies a charging current to the primary winding of the ignition coil and interrupts the charging current. First and second spark plugs are coupled to the ignition coil through first and second diodes, respectively. First and second capacitors are coupled in parallel across the gap of the first and second spark plugs, respectively.

As a result, only one ignition system is required for operation of the dual spark plugs. This results in reduced complexity and reduced cost. Further, such a connection promotes the simultaneous firing of both spark plugs. If one were to simply connect the output of one coil to the two spark plugs in any cylinder, only one of the plugs would usually fire in any given cycle. This is because the in cylinder conditions at each spark plug gap would be such that one of the two spark plug gaps requires a higher voltage to break down. The plug with the lower break down voltage would therefor fire while the other spark plug gap would most likely remain in an unfired condition.

In accordance with an embodiment of this invention, simultaneous firing of two plugs is promoted by isolating each spark plug gap from the ignition coil with a high voltage diode and having parallel capacitance to each plug gap.

DETAILED DESCRIPTION OF THE INVENTION

Figure 1:
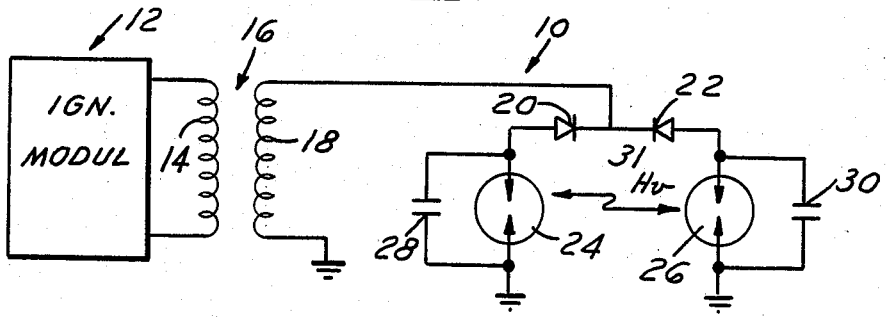
FIG. 1 is a schematic drawing of an ignition system in accordance with an embodiment of this invention.

Referring to FIG. 1, an ignition system 10 includes an ignition module 12 coupled to the primary coil 14 of an ignition coil 16. A secondary coil 18 of ignition coil 16 has one side grounded and the other side connected to a junction between a diode 20 and a diode 22. The other side of diode 20 from the junction is coupled to ground through a gap 24 of a spark plug. The other side of diode 22 is coupled to ground to the gap 26 of another spark plug. A capacitor 28 is coupled in parallel with gap 24. A capacitor 30 is coupled in parallel with the gap 26. Capacitors 28 and 30 help to balance the discharge energy between gaps 24 and 26 and have an initial stored energy equal to $\frac{1}{2}$ $CV^2$, where C is the capacitance and V is the lower breakdown voltage of the two gaps. Gaps 24 and 26 are positioned in the same cylinder so as to be optically coupled as indicated by radiation 31. Capacitors 28 and 30 also aid in changing the optical coupling between gaps 24 and 26 by intensifying the discharge and increasing the amount of ultraviolet radiation emitted.

Diodes 20 and 22 are advantageously high voltage diodes and perform the function of isolating capacitor 28 from gap 26 and isolating capacitor 30 from gap 24. As a result, both capacitors 28 and 30 will charge up to the same approximate voltage which will be approximately equal to that of the gap 24, 26 with the lower breakdown voltage. The conditions at the other gap, which requires a higher breakdown voltage, are constantly changing and therefore exhibit a varying breakdown voltage with time or crank angle. As a result, diodes 20 and 22 allow the charge stored on the capacitor in parallel with the nonfired gap to remain for a sufficient time for the gap to break down.

The reduction of the charge on the unfired capacitor is believed to resemble the charge decay of a simple resistor capacitor series circuit. For example, if the plug resistance is assumed to be 5 megohms and the capacitance to be 100 picofarads, the time constant is 5 microseconds. Such a system has been operated with a plug gap of about 0.04 inches and a parallel capacitance in the range of 100–200 picofarads. Successful spark firings have been done at frequencies from 10 to 50 hertz.

Figure 2:
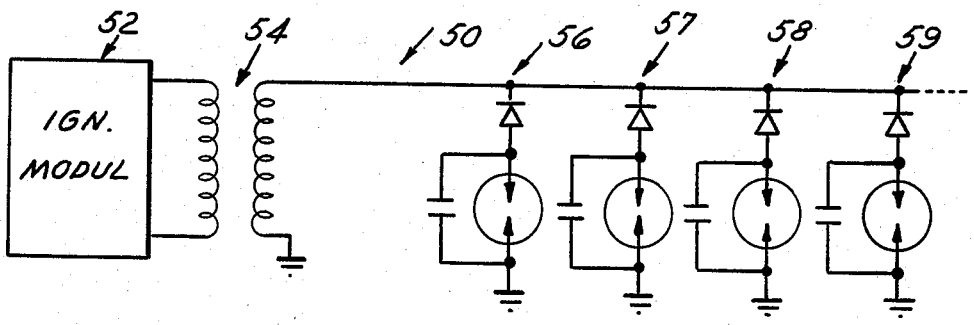
FIG. 2 is an embodiment of this invention similar to FIG. 1 with the addition of more spark plugs.

Referring to FIG. 2, an ignition system 50 has an ignition module 52 coupled to an ignition coil 54 which in turn is coupled to a plurality of diode spark capacitor combinations 56, 57, 58 and 59. The connection of the diode, capcitor and spark gap in each combination is the same as illustrated in FIG. 1. If desired, the capacitance can be an integral part of the spark plug. The size of such a capacitance can be varied by the configuration of the spark plug and by the type of material chosen as the dielectric.

An optical coupling effect between the spark plug gaps in the same cylinder aids in the firing of the unfired gap. The physical mechanism believed to be responsible for this effect is the emission of ultraviolet radiation from the first gap at breakdown. The addition of closely coupled parallel capacitance to each spark gap intensifies the discharge and thereby increases the amount of ultraviolet radiation emitted just after breakdowns of the first gap. A fraction of this radiation illuminates the cathode of the second gap and liberates photoelectrons which aids in reducing the breakdown voltage of the unfired gap toward the alternating current threshold level.

Various modifications and variations will no doubt occur to those skilled in the arts to which this invention pertains. For example, the particular configuration of the ignition coil may be varied from that disclosed herein. These and all other variations which basically rely on the teachings through which this disclosure has advanced the art are properly considered within the scope of this invention.

We claim:

1. An ignition system for an internal combustion engine having at least one cylinder comprising:

an ignition coil having a primary winding and a secondary winding, said secondary winding having a first and a second output terminal;

an ignition control circuit for applying a charging current to the primary winding of the ignition coil and for interrupting said charging current;

a first and a second spark ignition plug provided for each cylinder of the engine, each of said ignition plugs having at least one gap formed by first and a second spaced apart electrodes, said first and second plugs being positioned in the cylinder so as to be optically coupled to each other so that ultraviolet radiation from the first plug to fire in the cylinder is coupled to the other plug in the cylinder and aids in the firing of the other plug;

first and second connecting means for connecting said first spaced apart electrode of each gap of said first and second plugs, respectively, to ground;

a first diode coupled between said second electrode of said first plug and said first output terminal of said ignition coil;

a second diode coupled between said second electrode of said second plug and said first output terminal of said ignition coil;

a first capacitor means for providing a capacitance coupled across said first and second spaced apart electrodes of said first spark ignition plug; and a second capacitor means for providing a capacitance coupled across said first and second spaced apart electrodes of said second spark ignition plug.

2. An ignition system as recited in claim 1 further comprising:

a third spark ignition plug having at least one gap formed by first and second spaced apart electrodes, said third plug being positioned in the cylinder so as to be optically coupled to said first and second plugs so that ultraviolet radiation from the first plug to fire in the cylinder is coupled to the other plugs and aids in the firing of the other plugs in the cylinder;

third connecting means for connecting said first spaced apart electrode of said third plug to ground;

a third diode coupled between said second electrode of said third plug and said first output terminal of said ignition coil; and a third capacitor means for providing a capacitance coupled across said first and second spaced apart electrodes of said third spark ignition plug.

3. An ignition system as recited in claim 1 wherein said first and second capacitor means are an integral part of said first and second spark ignition plugs, respectively.

4. An ignition system as recited in claim 1 wherein said first and second capacitor means are separate components discrete from said first and second spark ignition plugs.

* * * * *